US006499618B1

(12) United States Patent
Leclerc et al.

(10) Patent No.: US 6,499,618 B1
(45) Date of Patent: Dec. 31, 2002

(54) SEALING DEVICE FOR A BOTTLE CONTAINING SPARKLING WINE

(75) Inventors: Pascal Leclerc, 71, rue Chaude Ruelle, 51200 Epernay (FR); Jean-Louis Ballu, Epernay (FR)

(73) Assignees: Etudes et Creation E.C.B., Epernay (FR); Pascal Leclerc, Epernay (FR)

( * ) Notice: Subject to any disclaimer, the term of this patent is extended or adjusted under 35 U.S.C. 154(b) by 0 days.

(21) Appl. No.: 09/786,475

(22) PCT Filed: Sep. 7, 1999

(86) PCT No.: PCT/FR99/02127

§ 371 (c)(1),
(2), (4) Date: Apr. 16, 2001

(87) PCT Pub. No.: WO00/13984

PCT Pub. Date: Mar. 16, 2000

(30) Foreign Application Priority Data

Sep. 7, 1998 (FR) ..... 98 11283
Nov. 2, 1998 (FR) ..... 98 13906

(51) Int. Cl.[7] ..... B65D 51/16
(52) U.S. Cl. ..... 215/364; 215/307; 215/291
(58) Field of Search ..... 215/364, 307, 215/296, 286, 285, 291, 247; 422/99, 100, 102; 604/435

(56) References Cited

U.S. PATENT DOCUMENTS 3,135,410 A * 6/1964 Federighi ..... 215/296
4,181,233 A * 1/1980 Gouveia ..... 215/247
4,394,921 A * 7/1983 Miskinis ..... 215/296
4,618,065 A * 10/1986 Guth ..... 215/3
5,358,872 A * 10/1994 Mussi et al. ..... 215/261

* cited by examiner

*Primary Examiner*—Nathan J. Newhouse
(74) *Attorney, Agent, or Firm*—Harrison & Egbert

(57) ABSTRACT

The invention concerns a device for sealing a bottle containing a sparkling wine and includes a stopper, particularly made of cork or a synthetic material, capable of being inserted in the neck of the bottle, maintained thereon by a wire cap, and run through in the axial direction, by a conduit having first and second ends capable of communicating respectively with the bottle's internal volume and external volume. The second end is closed by a retractable closer. The device is characterized in that the stopper is axially run through by an orifice designed to receive the conduit and having an adjusted and tight cross-section relative to the conduit external section, the latter being provided at its second end, with a support flange capable of resting against the stopper upper surface.

9 Claims, 1 Drawing Sheet

SEALING DEVICE FOR A BOTTLE CONTAINING SPARKLING WINE

BACKGROUND OF THE INVENTION (1) Field of the Invention

The invention relates to a device for ensuring the sealing of a bottle containing sparkling wine and includes a plug, namely made of cork or of synthetic material, capable of being inserted into the neck of said bottle, maintained on the latter through a cork wiring, and through which passes, in axial direction, a duct including a first and a second end capable of communicating with the inner volume or the outer volume, respectively, of the bottle, said second end being closed by a retractable seal.

This invention will find its application in the field of the manufacture of devices for closing bottles containing sparkling wine.

(2) Description of Related Art

Plugs capable of being inserted into the neck of a bottle containing sparkling wine are already known.

The latter produces indeed pressurized gases likely to expulse said plug that, in order to avoid such an expulsion, is completed with a cork wiring capable of co-operating with said neck and aimed at maintaining said plug on the bottle.

Now, at the moment of opening such a bottle of sparkling wine and after having removed the cork wiring, it often happens that, due to this gas pressure, the plug cannot be held under control by the person who removes the plug.

In addition to the fact that such a plug, propelled at high speed, can cause material damage, it is also capable of injuring somebody, which is of course even more serious and therefore unacceptable.

In order to cope with this problem, there have already been devised devices allowing degassing a bottle prior to proceeding to opening it.

In particular, mechanically expandable plugs are known, which are therefore radially pressure-released before the cork wiring is removed, while creating a passageway allowing the gases to be released. As a matter of fact, such plugs are of a complex design and necessarily made of synthetic material, which undeniably limits their application.

German Patent 3901711 describes a sealing device for a bottle containing sparkling wine. Such a device is in the form of a plug through which passes a duct including an inner channel at the level of which is provided for a internal thread. The latter is capable of cooperating with the external thread of a threaded rod screwed into said duct. Such a device allows, through unscrewing said rod, the release of the gases contained in the bottle.

One should note that in such a device the rod as well as the duct are made of synthetic material. In this respect, one should note that it is particularly difficult to achieve an appropriate tightness between the external thread of the rod and the internal thread of the duct, this with a rod and a duct made of such synthetic material. Hence, one notices many leaks at the level of the cooperation between the external thread and the internal thread of this device, which is not acceptable for sparkling wine, in particular for high-quality wine.

BRIEF SUMMARY OF THE INVENTION

This invention allows coping with the drawbacks of the sealing device known in the state of the art, and this through a new, particularly astute device.

To this end, the invention relates to a device for ensuring the sealing of a bottle containing sparkling wine and includes a plug, namely made of cork or of synthetic material, capable of being inserted into the neck of said bottle, maintained on the latter through a cork wiring, and through which passes, axially, a hole for receiving a duct including a first and a second end capable of communicating with the inner volume or the outer volume, respectively, of the bottle, said second end being closed by a retractable seal, characterized in that said hole has a cross-section tightly fitting the outer cross-section of said duct, the latter being provided, at the level of its second end, with a resting flange, on the one hand, capable of resting against the upper surface of said plug and, on the other hand, against which said seal defined by a lip is inserted.

According to an additional feature, the ratio between the cross-section of the duct and the cross-section of the hole in the plug varies between 1.05 and 1.36.

More specifically, the ratio between the cross-section of the duct and the cross-section of the hole in the plug is of about 1.15 and, preferably, the cross-section of said duct is of about 3 mm, while that of the hole is of about 2.6 mm.

Another feature of this invention relates to said duct, which is made of a food-type semi-rigid synthetic material, preferably PET.

According to an additional feature, the second end of said duct includes a portion protruding out of said plug and, through distortion, namely through a raise in temperature, defines the resting flange.

Another peculiarity of this invention is that said seal is defined by a lip inserted against the resting flange.

As a matter of fact, said lip is inserted against the flange through heat sealing.

According to an additional feature, the plug receives, at the level of its upper surface, a cap capable of cooperating with said cork wiring and provided with an opening aimed at providing access to the retractable seal.

As a matter of fact, the opening of said cap has a substantially circular shape and has a diameter varying between 8 and 12 mm, preferably equal to 10 mm, so as to allow seizing said cap, through magnetization, to place it on the plug.

Another feature is that said plug has an outer diameter and that the ratio between the outer diameter of the plug and the inner diameter of the neck varies between 1.52 and 1.7, this ratio being preferably equal to 1.64.

The advantages of this invention reside in that said device authorizes an evacuation of the gases contained in a bottle of sparkling wine, by proceeding to removing the retractable seal. This allows creating inside said bottle a pressure in the range of that of the atmospheric pressure, which impedes the plug from being expulsed when the cork wiring is removed.

As a matter of fact, one should note that the duct is inserted by force into the plug, before the latter is placed into the neck of the bottle. In this respect, one should note that said duct is made of semi-rigid material allowing, on the one hand, its insertion by force into the plug and, on the other hand, placing the latter in the neck, this without suffering damages despite the stresses exerted on the sealing device according to the invention during its manufacture and its putting in place.

This duct as well as, eventually, said plug are, as a matter of fact, defined so as to allow placing the sealing device according to the invention on the bottle by means of a corking machine of a traditional design usually used for ensuring the placing of traditional plugs, namely of massive cork. Thus, said sealing device according to the invention does not require designing a new corking machine, but advantageously allows using existing machines.

During the process of placing such a sealing device, one proceeds, after inserting the plug into the neck and before placing said cork wiring, to covering said plug with a cap, the handling of the latter occurring through magnetization. In this respect, one should observe that the size of the opening in this cap is so defined as to advantageously allow seizing, through magnetization, said cap by means of an appropriate organ an existing corking machine of a traditional design is provided with.

The presence of this opening at the level of said cap advantageously allows acceding to the lip of the retractable seal, in order to ensure its removal, while maintaining the cork wiring in place on the bottle.

This invention will be better understood when reading the following description, with reference to the attached drawing.

DESCRIPTION OF THE INVENTION

Figure 2:
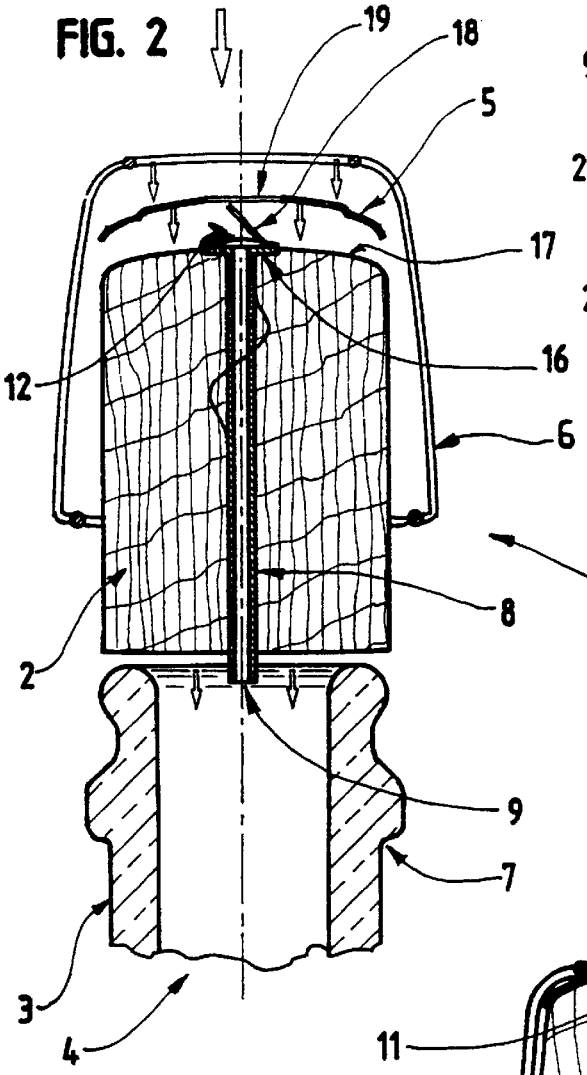
FIG. 2 is an exploded schematic view, corresponding to the sealing device according to the invention completed with a cap and a cork wiring aimed at being placed on the neck of a bottle.
Figure 1:
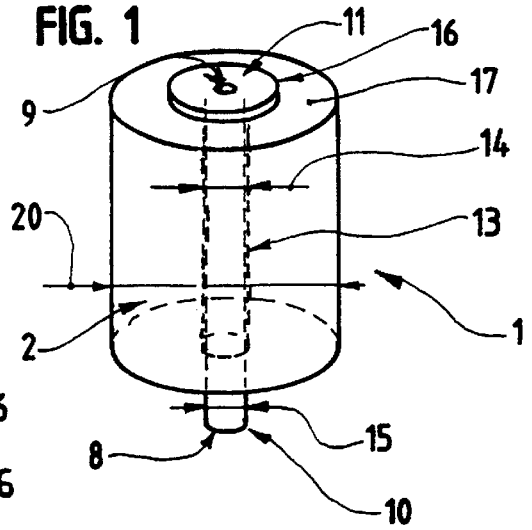
FIG. 1 corresponds to a schematic perspective view of a sealing device for a bottle including a plug provided with a duct, according to the invention.
Figure 3:
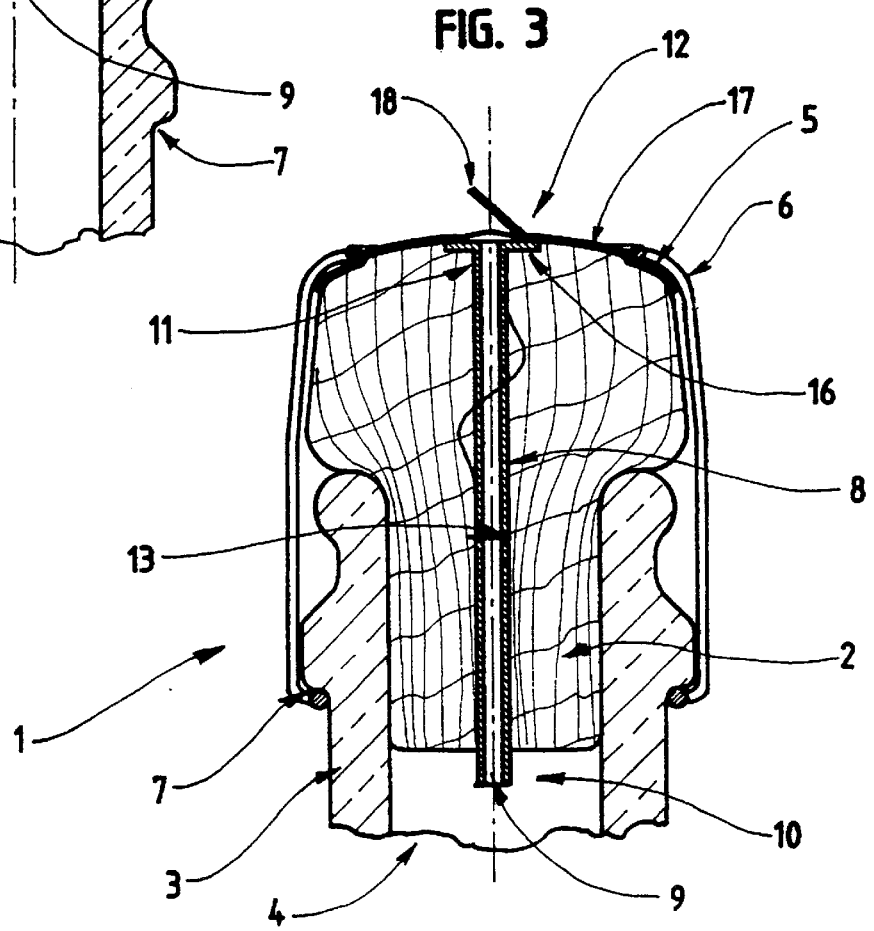
FIG. 3 is a cross-sectional view of such a sealing device immobilized on said bottle.

This invention is related to the field of the manufacture of devices capable of ensuring the sealing of a bottle containing sparkling wine.

Such a sealing device 1 is in the form of a plug 2 made of cork or synthetic material and aimed at being inserted, at least partially, into the neck 3 of a bottle 4.

Such a plug 2 is capable of cooperating with a cap 5, namely having a substantially circular shape, capable of covering said plug 2, e.g. after inserting the latter into the bottle 4.

This cap 5 is so designed as to be capable of cooperating with a cork wiring 6 aimed at ensuring maintaining, on said bottle 4, said plug 2, against the pressure exerted on the latter 2 by the gases produced by the wine contained in said bottle 4.

Such a cork wiring 6 is capable, on the one hand, of resting, at its upper portion, on said cap 5 and, on the other hand, of being clamped, at its lower portion, onto the neck 3 of said bottle 4, at the level of a rim 7 that the neck 3 of the bottle 4 is provided with.

As a matter of fact, through said plug 2 passes, in axial direction, a duct 8 aimed at communicating the inner volume and the outer volume of the bottle 4, through a channel 9 said duct 8 includes.

As a matter of fact, said duct 8 includes, on the one hand, a first end 10 capable of communicating with the inner volume of said bottle 4. Said duct 8 includes, on the other hand, a second end 11 capable of communicating with the outer volume of said bottle 4 and closed by a retractable seal 12.

According to the invention, through said plug 2 passes axially a hole 13 aimed at receiving said duct 8.

This hole 13 is defined by a bore, with removal of material, provided for in said plug 2 and has a cross-section 14 tightly fitting the outer cross-section 15 of said duct 8.

As a matter of fact, such a tight fit of said cross-sections 14 and 15 requires, when placing said duct 8, a forced insertion of the latter into the hole 13 of the plug 2.

These cross-sections 14 and 15 are, in addition, so determined that the contact between the outer wall of said duct 8 and the inner wall of the hole 13 of the plug 2 is tight and impedes, at the level of this contact, any diffusion of the gases from the inside to the outside of the bottle 4.

As a matter of fact, such a tight fit is achieved with a ratio between the cross-section 15 of the duct 8 and the cross-section 14 of the hole 13 in the plug 2 varying between 1.05 and 1.36.

According to a preferred embodiment of this invention, this ratio is equal to about 1.15. In this respect, one should note that good results are achieved with a particular embodiment in which the cross-section 15 of the duct 8 is of about 3 mm, while the cross-section 14 of the hole 13 is of about 2.6 mm.

One should note, in addition, that the duct 8 has an internal channel 9 the inner diameter of which is very small. in particular at least ten times smaller than the diameter of the neck 3 of the bottle 4, so that the force due to the pressure exerted on the retractable cover 12 by the internal gases is very low.

As a matter of fact, the diameter of this channel 9 is, preferably, substantially equal to one third of that of said duct 8. In the particular case of a duct 8 with a diameter in the range of 3 mm, the diameter of said channel 9 is then of about 1 mm.

According to another feature of this invention, said duct 8 has, at the level of its second end 11, a flange 16 capable of resting against the upper surface 17 of said plug 2.

As regards said duct 8, it is made out of a food-type semi-rigid synthetic material, preferably PET. The material defining said duct 8 should also be capable of defining a tight barrier to carbon dioxide and to oxygen.

As a matter of fact, said duct 8 should have a rigidity that authorizes, on the one hand, its insertion by force into said plug 2 and, on the other hand, the insertion of the latter, provided with said duct 8, into the neck 3 of the bottle 4.

In this respect, one should note that, according to a first embodiment, said duct 8 is in the form of a tube inserted by force into said hole 13 of the plug 2.

Once said duct 8 has been inserted, it has a portion protruding out of said plug 2, at the level of the upper surface 17 of the latter. In particular, this protruding portion will, through distortion, namely through a raise in temperature, define said resting flange 16.

According to another embodiment, said duct 8 is subjected to such a distortion prior to being inserted into said plug 2. This duct 8 is then inserted by force into the hole 13 and strikes, more or less violently, against the upper surface 17 of said plug 2. One easily understands why this duct 8 should be made out of semi-rigid material, to avoid any risk of deterioration.

As a matter of fact, as far as the distortion aimed at defining said resting flange 16 is concerned, it is carried out by means of a heating die provided with means capable of impeding the sealing off of the channel 9 of said duct 8.

Another feature of this invention is that said retractable seal 12 is defined by a retractable lip 18 inserted against the resting flange 16.

As a matter of fact and according to a preferred embodiment, such a lip 18 is made integral with said flange 16 through heat-sealing.

As has been evoked above, the plug 2 receives, at the level of its upper surface 17, a cap 5 capable of cooperating with a cork wiring 6. Said cap 5 is inserted above the plug 2, after placing the latter on the neck 3 of the bottle 4.

According to an additional feature of this invention, said cap 5 includes an opening 19 aimed at allowing the access to the retractable seal 12.

The latter adopts, as a matter of fact, the form of a lip 18, preferably crumpled up, in order to facilitate, on the one hand, its protruding through said cap 5 and, on the other hand, its seizing.

According to a preferred embodiment of this invention, the opening 19 has a size larger than that of said resting flange 16, so as to position itself around the latter without exerting any stress on it.

According to another embodiment, the size of this opening 19 is smaller than that of said resting flange 16, to the contraty, so as to rest on the latter.

As a matter of fact, one should note that said cap 5 is made of a metallic material and that its placing over said plug 2 occurs by means of an organ provided with a magnet and which a corking machine, preferably of a traditional type, is provided with. The seizing of such a cap 5 occurs, accordingly, through magnetization and it is necessary for this cap 5 to have a sufficient surface, in order to allow a seizing of that kind.

The quality of this seizing, for a same diameter of the cap 5, depends indeed on the nature and the size of said opening 19 that therefore adopts a substantially circular shape and has a diameter varying between 8 and 12 mm, this diameter being preferably equal to about 10 mm.

Finally, one should note that the carrying out of the hole 13 at the level of said plug 2 and the placing, in a tight way, of a semi-rigid duct 8 has a tendency to rigidify the sealing device 1 and to reduce its flexibility. This results into making more difficult the distortion of such a plug 2 when inserting it into the neck 3.

In order to cope with this drawback, this invention also consists in reducing the outer diameter 20 of a plug 2 provided with a duct 8, compared to the outer diameter of a traditional plug made of massive material.

In this respect, one should note that an appropriate distortion of said plug 2, according to the invention, is achieved with a ratio between the outer diameter 20 of the plug 2 and the inner diameter of the neck 3 varying between 1.52 and 1.7. This ratio is preferably equal to about 1.64.

Hence, for a traditional neck 3 the inner diameter of which is in the range of 18 mm, the outer diameter 20 of the plug 2 according to the invention varies between 27.5 and 30.5 mm, is preferably equal to about 29.5 mm.

What is claimed is:

1. Device (1) for ensuring the sealing of a bottle (4) containing sparkling wine comprising a plug (2), namely made of cork or of synthetic material, capable of being inserted into the neck (3) of said bottle (4), maintained on the latter through a cork wiring (6), and through which passes, axially, a hole (13) for receiving a duct (8) comprising a first (10) and a second (11) end capable of communicating with the inner volume or the outer volume, respectively, of the bottle (4), said second end (11) being closed by a retractable seal (12), characterized in that said hole (13) has a cross-section (14) tightly fitting the outer cross-section (15) of said duct (8), the latter (8) being provided, at the level of its second end (11), with a resting flange (16), on the one hand, capable of resting against the upper surface (17) of said plug (2) and, on the other hand, against which said seal (12) defined by a lip (18) is inserted.

2. Sealing device (1) according to claim 1, wherein a ratio between the cross-section (15) of the duct (8) and the cross-section (14) of the hole (13) in the plug (2) varies between 1.05 and 1.36.

3. Sealing device (1) according to claim 2, wherein a ratio between the cross-section (15) of the duct (8) and the cross-section (14) of the hole (13) in the plug (2) is about 1.15 and that, preferably, the cross-section (15) of said duct (8) is of about 3 mm, while that (14) of said hole (13) is of about 2.6 mm.

4. Sealing device (1) according to claim 1, wherein said duct (8) is comprised of a food-type semi-rigid synthetic material, preferably PET.

5. Sealing device (1) according to claim 1, wherein the second end (11) of said duct (8) comprises a portion protruding out of said plug (2) and which, through distortion, namely through a raise in temperature, defines the resting flange (16).

6. Sealing device (1) according to claim 1, wherein a lip (18) is inserted against the resting flange (16) through heat-sealing.

7. Sealing device (1) according to claim 1, wherein said plug (2) receives, at the level of its upper surface (17), a cap (5) capable of cooperating with said cork wiring (6) and comprised of an opening (19) aimed at allowing the access to the retractable seal (12).

8. Sealing device (1) according to claim 7, wherein said opening (19) of said cap (5) has a substantially circular shape and has a diameter varying between 8 and 12 mm, so as to allow seizing said cap (5), through magnetization, to place it on the plug (2).

9. Sealing device (1) according to claim 1, wherein said plug (2) has an outer diameter (20); and wherein a ratio between the outer diameter (20) of the plug (2) and the inner diameter of the neck (3) varies between 1.52 and 1.7.

* * * * *